US011162287B2

(12) United States Patent
Lee

(10) Patent No.: US 11,162,287 B2
(45) Date of Patent: Nov. 2, 2021

(54) MULTI-LINK DOOR HINGE

(71) Applicant: SEO WON KOREA CO., LTD., Gimhae-si (KR)

(72) Inventor: June Young Lee, Busan (KR)

(73) Assignee: SEO WON KOREA CO., LTD.

( * ) Notice: Subject to any disclaimer, the term of this patent is extended or adjusted under 35 U.S.C. 154(b) by 104 days.

(21) Appl. No.: 16/708,548

(22) Filed: Dec. 10, 2019

(65) Prior Publication Data

US 2021/0054670 A1 Feb. 25, 2021

(30) Foreign Application Priority Data

Aug. 21, 2019 (KR) ..... 10-2019-0102058

(51) Int. Cl.
*E05F 3/20* (2006.01)
*E05D 3/16* (2006.01)

(52) U.S. Cl.
CPC ..... *E05F 3/20* (2013.01); *E05D 3/16* (2013.01); *E05Y 2201/41* (2013.01); *E05Y 2900/20* (2013.01); *E05Y 2900/30* (2013.01)

(58) Field of Classification Search
CPC .. E05F 3/20; E05F 1/1261; E05D 3/16; E05D 2003/166; E05Y 2900/20; E05Y 2900/30; Y10T 16/304
See application file for complete search history.

(56) References Cited

U.S. PATENT DOCUMENTS 4,075,735 A * 2/1978 Rock ..... E05D 11/1021 16/278
4,837,894 A * 6/1989 Lin ..... E05D 3/16 16/288
6,438,799 B1 * 8/2002 Gronbach ..... E05F 1/1261 16/249
6,499,189 B2 * 12/2002 Kondo ..... E05D 3/06 16/239
8,296,906 B2 * 10/2012 Wisniewski ..... E05D 3/14 16/370
10,845,116 B2 * 11/2020 Hunter ..... E05D 3/16
2003/0159249 A1 * 8/2003 Tsung-Lung ..... E05D 11/1021 16/371
2008/0276422 A1 * 11/2008 Beckmann ..... E05D 11/0054 16/258

FOREIGN PATENT DOCUMENTS

DE 9107000 U1 * 10/1991
KR 10-1971950 B1 4/2019

* cited by examiner

*Primary Examiner* — Victor D Batson
*Assistant Examiner* — Matthew J Sullivan
(74) *Attorney, Agent, or Firm* — Park & Associates IP Law, P.C.

(57) ABSTRACT

A multi-link door hinge capable of facilitating the closing of a door and implementing the shock-absorbing performance of the door during the closing thereof. To this end, the multi-link door hinge includes: a main frame mounted to a main body of an object having a door; a door frame mounted to the door; a body frame rotatably connected to a first side of the main frame; an inner link and an outer link connecting the door frame to the body frame; a plate spring link allowing the outer link to be rotatably connected to the main frame; a locking piece rotatably mounted between side walls of the inner link; an elastic member; and a hook, a first side of which is fixed in the body frame and a second side of which is configured to be held in a second side of the locking piece.

4 Claims, 8 Drawing Sheets

MULTI-LINK DOOR HINGE

REFERENCE TO RELATED APPLICATIONS

This application claims the priority benefit of Korean Patent Application No. 10-2019-0102058 filed on Aug. 21, 2019, the entire contents of which are incorporated herein by reference.

FIELD OF THE INVENTION

The present invention relates to a multi-link hinge apparatus that can easily open and close a door of objects such as home appliances and furniture.

BACKGROUND OF THE INVENTION

Generally, as for objects such as home appliances and furniture provided with a door, the door is hinged to a main body to open and close the main body, so the main body can be opened and closed by rotating the door.

As built-in home appliances and refrigerators become larger in recent years, the size of a door has also increased, whereby the range of rotation of the door to the main body is increased. As a result, the installation space of the refrigerator is limited. Accordingly, to reduce space required during the opening and closing of a door, a need for a hinge allowing the rotating space of the door to be reduced when rotating the door to a main body is increasing.

In addition, a hinge technology for providing a convenience function when opening and closing a door is required, and in particular, demand for a hinge technology for easily inducing the closing of the door is increasing.

SUMMARY OF THE INVENTION

Accordingly, the present invention has been made keeping in mind the above problems occurring in the related art, and the present invention is intended to propose a multi-link door hinge capable of facilitating the closing of a door and implementing the shock-absorbing performance of the door during the closing thereof.

Along with this, the other objectives and advantages of the present invention will be described below and will cover wider objectives and advantages due to matters described in the claims of the present invention and the disclosure of an exemplary embodiment thereof and due to means and combinations within a range easily conceivable therefrom. Please note that it will be covered in a wide range.

In order to achieve the above objectives, according to one aspect of the present invention, there is provided a multi-link door hinge including: a main frame mounted to a main body of an object having a door; a door frame mounted to the door; a body frame rotatably connected to a first side of the main frame; an inner link and an outer link connecting the door frame to the body frame such that the door frame and the body frame are rotated relative to each other; a plate spring link allowing the outer link to be rotatably connected to the main frame; a locking piece rotatably mounted between side walls of the inner link; an elastic member, a first side of which is provided in the inner link and a second side of which is rotatably combined with a first side of the locking piece to provide a pushing force to the locking piece, so that the locking piece is rotated counterclockwise in response to an opening motion of the door and the locking piece is rotated clockwise in response to a closing motion of the door; and a hook, a first side of which is fixed in the body frame and a second side of which is configured to be held in a second side of the locking piece, so that the hook is held in the locking piece in response to the closing motion of the door and the pushing force caused by the elastic member is transmitted to the body frame, thus facilitating the closing of the door.

In addition, according to the exemplary embodiment of the present invention, the locking piece may include: a body part having a first hinge hole through which the body part is connected to the side walls of the inner link; a pair of bracket wings provided by extending from a first side of the body part, a second hinge hole being provided in each of the bracket wings; a nose part provided by extending from a second side of the body part, the nose part including a first concave surface part configured by being concavely rounded on a lower surface thereof and a convex surface part configured by being convexly rounded at an end part of the first concave surface part; and a jaw part provided by extending from a lower surface of the body part, and including a second concave surface part configured by being concavely rounded at a side opposing to the first concave surface part and a protruding surface part provided by protruding from an end part of the second concave surface part, wherein the jaw part may define a locking mouth in cooperation with the nose part such that the hook is inserted into and held in the locking mouth.

Additionally, according to the exemplary embodiment of the present invention, the elastic member may include: a spring holder having a rod, a first side of which is inserted into an installation hole provided in a fixing plate installed in the inner link, and a head provided at a second side of the rod and arranged between the bracket wings, the head having a joint groove part through which the head is rotatably connected to the second hinge hole; and a spring inserted into the rod and supported by the fixing plate at a first side thereof and being in close contact with the head at a second side thereof, thus supplying the pushing force to the locking piece.

Furthermore, according to the exemplary embodiment of the present invention, a first end of the hook may be fixed to the body frame and a connection bar may be provided in a second end of the hook, so that when the locking piece is rotated clockwise at a predetermined angle or more in response to the closing motion of the door, the hook may be gradually inserted into and held in the locking mouth so as to transmit the pushing force caused by the elastic member to the body frame.

In addition, according to the exemplary embodiment of the present invention, the multi-link door hinge may further include: a cylindrical cam provided on a rotating shaft of the main frame and the body frame, and a bumper protrusion provided on an outer circumferential surface of the cylindrical cam by protruding therefrom along a tangential direction thereof and configured to come into contact with the main frame immediately prior to the closing of the door.

According to the present invention as described above, the following effects can be expected.

The multi-link door hinge of the present invention is capable of facilitating the closing of a door and implementing the shock-absorbing performance of the door during the closing thereof, thereby facilitating a user's convenience, guaranteeing the closing of the door, and improving the durability of the door.

In addition, the other effects of the present invention include not only the effects described in the above-described embodiment and claims of the present invention, but also effects that may occur within a range easily inferred therefrom and potential advantages of a wider scope of contributing to industrial development.

BRIEF DESCRIPTION OF THE DRAWINGS

The above and other objectives, features, and other advantages of the present invention will be more clearly understood from the following detailed description when taken in conjunction with the accompanying drawings, in which.

DETAILED DESCRIPTION OF THE INVENTION

Figure 1:
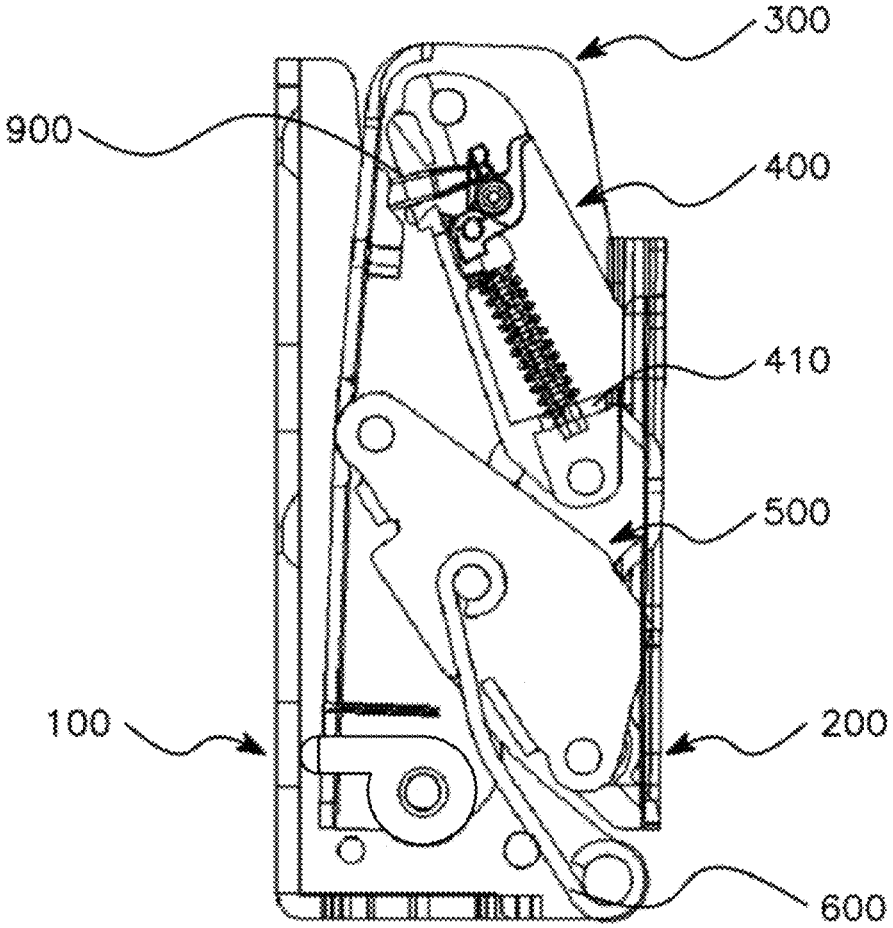
FIGS. 1 to 5 are views illustrating step by step operation states of a multi-link door hinge according to the present invention from a point immediately prior to a closing of a door to a point of opening thereof.

Hereinbelow, an exemplary embodiment of the present invention will be described in detail with reference to the accompanying drawings. Prior to the description, the advantages and features of the present invention and methods of achieving them will be apparent with reference to the embodiment described below in detail with the accompanying drawings. The terminology used herein is only for the purpose of describing the embodiment and is not intended to limit the present invention. Singular terms used herein include plural terms unless the context clearly indicates otherwise, and it is noted that terms indicating directions in the description are intended to help a person understand the description and may be changed according to time.

The present invention is intended to propose a multi-link door hinge which can facilitate the closing of a door which opens and closes objects such as home appliances and furniture and implement a shock-absorbing performance of the door during the closing thereof. The present invention will be described in detail with reference to the accompanying drawings hereinbelow.

As illustrated in FIGS. 1 to 5, the multi-link door hinge of the present invention is configured to include a main frame 100, a door frame 200, a body frame 300, an inner link 400, an outer link 500, a plate spring link 600, a locking piece 700, an elastic member 800, and a hook 900.

The main frame 100 is mounted to a main body of an object having a door, and is configured to include an angle plate of an "L" shape combined with the main body and side walls provided at opposite sides of the angle plate. Accordingly, the body frame 300, the inner link 400, the outer link 500, and the plate spring link 600 can be folded between the side walls of the main frame due to a closing motion of the door.

In addition, the door frame 200 is configured to include a top plate combined with a side surface of the vicinity of an edge of the door and side walls provided at opposite sides of the top plate. Accordingly, the inner link 400 and the outer link 500 can be folded between the side walls of the door frame due to the closing motion of the door.

Furthermore, the body frame 300 is configured to include side walls provided at opposite sides thereof and a bottom plate supporting the side walls by connecting the side walls to each other. A first side of each of the side walls of the body frame is inserted into and rotatably and axially (via a main rotating shaft) combined with a first side of each of the side walls of the main frame 100. Accordingly, the body frame 300 serves as the most important frame in the hinge operation of the door.

Next, opposite sides of each of the inner link 400 and the outer link 500 are inserted into and mutually and rotatably connected to the side walls of the door frame 200 and the body frame 300, so unfolding and folding of the door frame 200 and the body frame 300 are performed therebetween.

That is, the outer link 500 is configured to include side walls provided at opposite side thereof and a structure of firmly connecting the side walls, wherein a first side of each of the side walls of the outer link is rotatably and axially combined with a first side of each of the side walls of the door frame 200, and a second side of each of the side walls of the outer link is rotatably and axially combined with a middle part of each of the side walls of the body frame 300. Furthermore, the inner link 400 is configured to include side walls provided at opposite sides thereof and a bottom plate supporting the side walls by connecting the side walls to each other. A first side of each of the side walls of the inner link is rotatably and axially combined with a second side of each of the side walls of the door frame, and a second side of each of the side walls of the inner link is rotatably and axially combined with a second side of each of the side walls of the body frame 300.

Next, a first side of the plate spring link 600 is rotatably and axially combined with an end part of the first side of the main frame, and a second side thereof is rotatably and axially combined with a middle portion of each of the side walls of the outer link 500. Accordingly, the door is prevented from deviating from the radius of rotation of the body frame 300.

Figure 6:
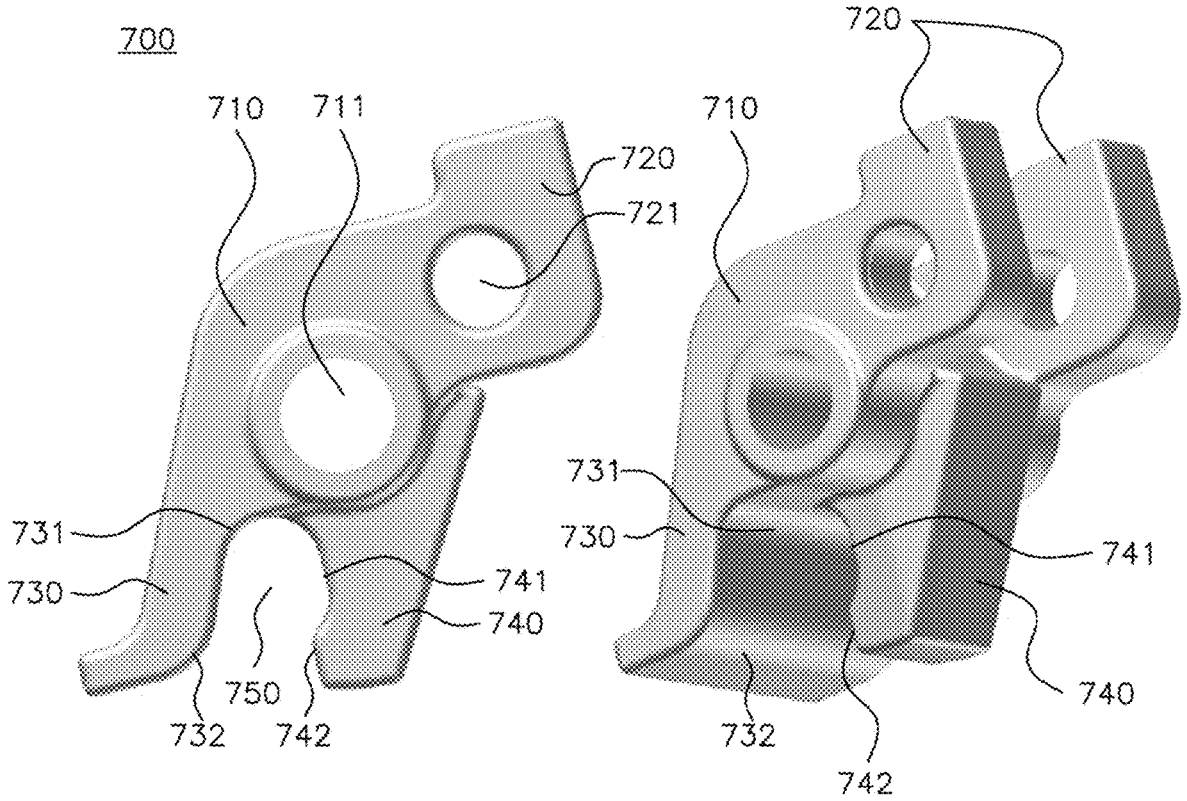
FIG. 6 is a view illustrating in detail a locking piece of the multi-link door hinge according to the present invention.
Figure 9:
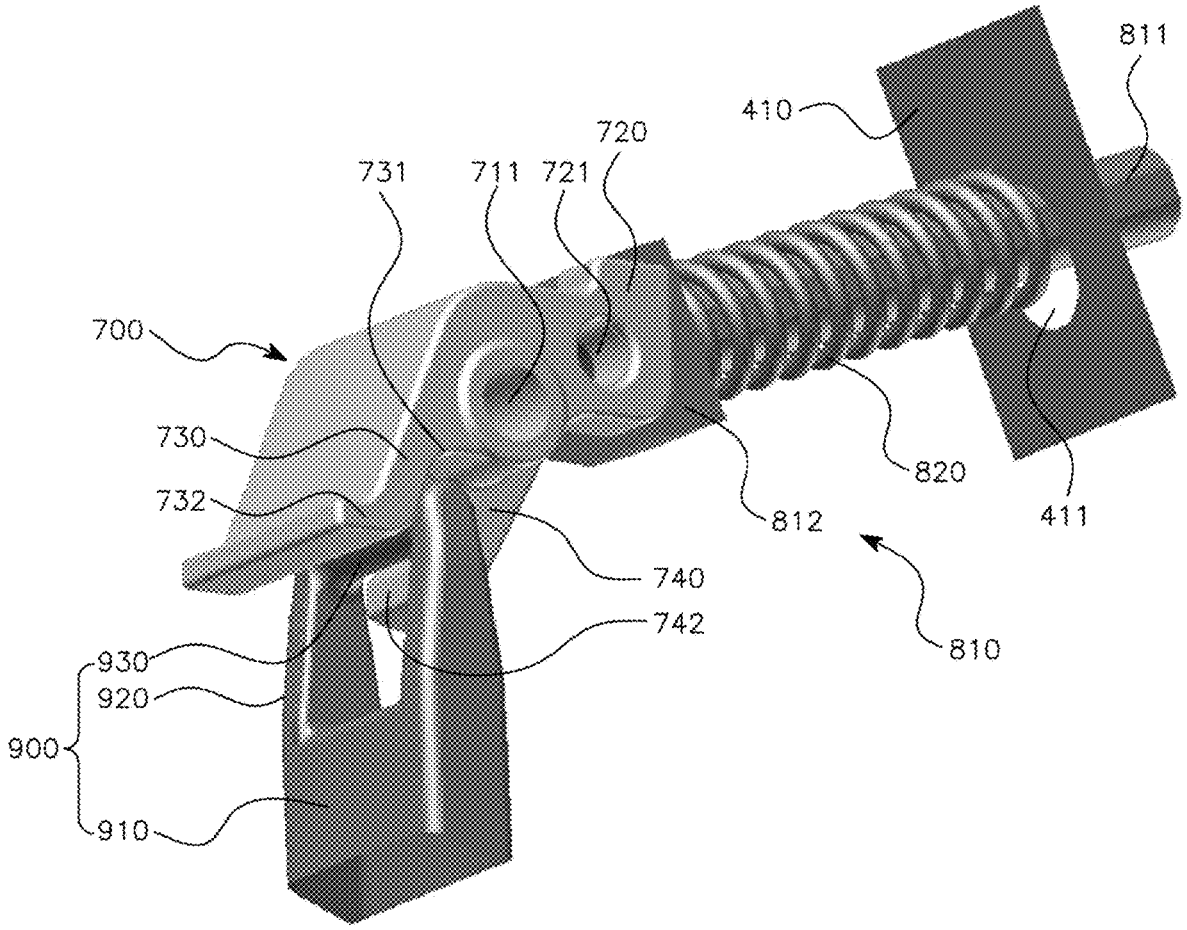
FIG. 9 is a view illustrating in detail the combination relation of the locking piece, the spring holder, and the hook of FIG. 2.

Furthermore, the locking piece 700 is rotatably provided between the side walls of the inner link 400 and is configured to include a body part 710, a bracket wing 720, a nose part 730, and a jaw part 740 as illustrated in the drawings described above and FIGS. 6 and 9.

The body part 710 includes a first hinge hole 711 to be rotatably and axially combined with each of the side walls of the inner link 400. Furthermore, the bracket wing 720 is provided by extending in a pair from a first side of the body part 710, the bracket wings being spaced apart by a predetermined interval from each other, wherein a second hinge hole 721 is formed in each of the bracket wings.

In addition, the nose part 730 is configured to include a first concave surface part 731 and a convex surface part 732. The first concave surface part 731 is provided by extending from a second side of the body part 710 and is configured by being concavely rounded. Furthermore, the convex surface part 732 is configured by being convexly rounded at an end part of the first concave surface part 731, so an end part of the nose part 730 is configured to be shaped like a nose that can be caught somewhere.

Next, the jaw part 740 is provided by extending from a lower surface of the body part 710 and is configured to include a second concave surface part 741 and a protruding surface part 742. The second concave surface part 741 is configured by being concavely rounded at a side opposing to the first concave surface part 731, and the protruding surface part 742 is provided by protruding from an end part of the second concave surface part 741. Accordingly, the jaw part 740 defines a locking mouth 750 in cooperation with the nose part 730 such that the hook 900 is inserted into and held in the locking mouth.

Figure 7:
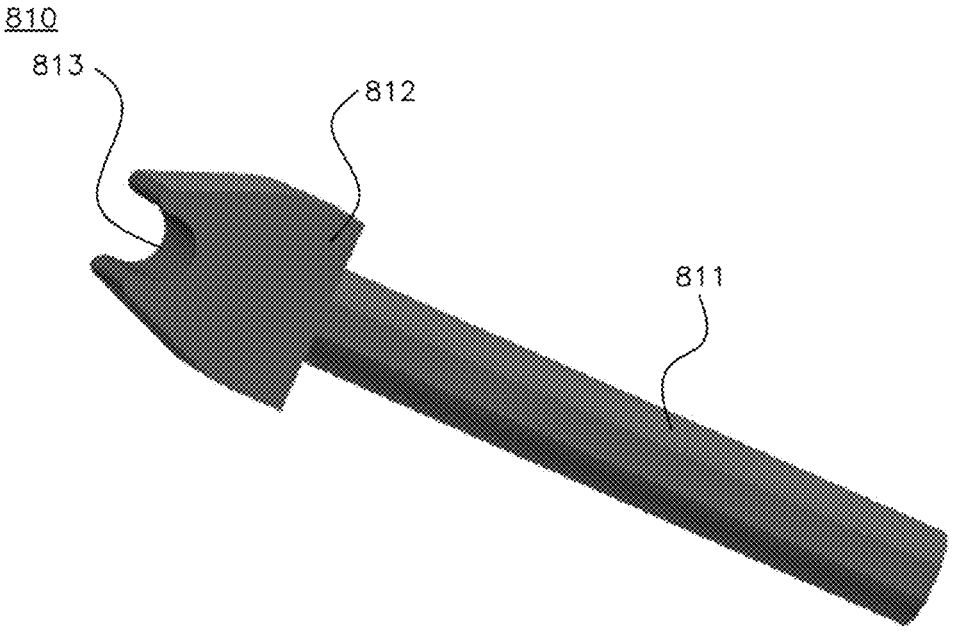
FIG. 7 is a view illustrating in detail a spring holder of the multi-link door hinge according to the present invention.

Next, as illustrated in the drawings described above and FIGS. 7 and 9, the elastic member 800 includes a spring holder 810 and a spring 820.

Such a spring holder 810 is configured to include a rod 811 and a head 812. A first side of the rod 811 is inserted into and held in an installation hole 411 formed in a fixing plate 410 installed in the inner link 400. The diameter of the installation hole 411 is formed so that the rod 811 can be inserted thereinto and move freely, and the spring, which will be described later, cannot escape. Furthermore, the head 812 is provided at a second side of the rod 811 and is arranged between the bracket wings 720, and includes a joint groove part 813 through which the head is rotatably and axially combined with the second hinge hole 721.

In addition, the spring 820 is inserted into the rod 811 and a first side of which is supported by the fixing plate 410 and a second side of which is in close contact with the head 812 so as to supply a pushing force to the locking piece 700.

Figure 8:
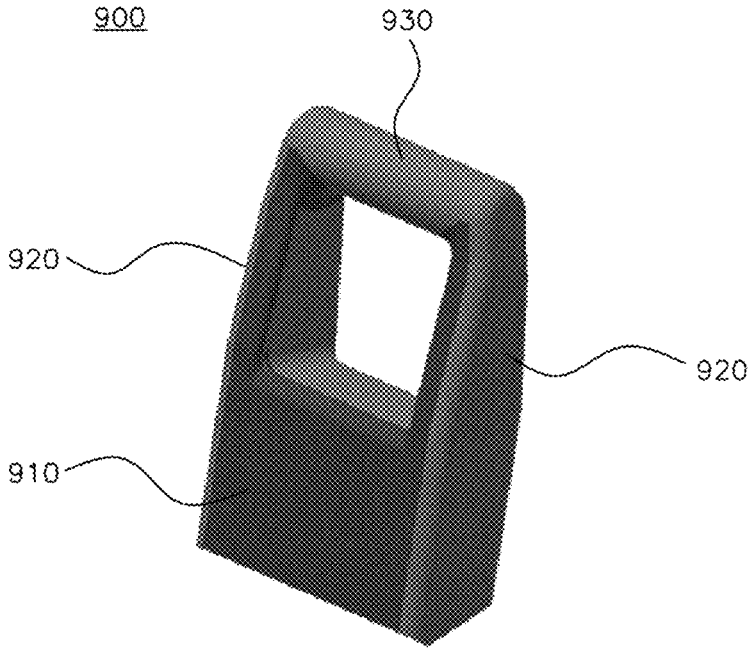
FIG. 8 is a view illustrating in detail a hook of the multi-link door hinge according to the present invention.

Furthermore, as illustrated in the drawings described above and FIGS. 8 and 9, the hook 900 is configured to include a support block 910, a pair of support bars 920, and a connection bar 930.

A first end of the support block 910 is fixed to the bottom plate of the body frame 300, not in a direction perpendicular to the bottom plate of the body frame 300, but in a direction diagonal thereto to be tilted slightly.

In addition, the pair of support bars 920 are formed by extending from opposite sides of a second end of the support block 910, and the connection bar 930 connects end parts of each of the support bars 920.

The connection bar 930 is gradually inserted into and held in the locking mouth 750 when the locking piece 700 is rotated clockwise at a predetermined angle or more in response to the closing motion of the door, so that the pushing force by the elastic member 800 is transmitted to the body frame 300 and the closing of the door is easily performed.

Here, the hook 900 passes through an open part provided in the bottom plate of the inner link 400 and is held in the locking piece 700 in response to the closing motion of the door, while the hook 900 is removed from the locking piece 700 and exits through the open part in response to an opening motion of the door. In addition, the jaw part 740 of the locking piece 700 is configured to have a sufficient size to protrude between the support bar 920 and the connection bar 930. In addition, a stopper is provided in the vicinity of the open part formed in the bottom plate of the inner link 400 such that the nose part 730 of the locking piece 700 and an end part of the jaw part 740 are held by the stopper. Accordingly, during the opening motion of the door, a counterclockwise rotation angle of the locking piece 700 is preferably limited.

Figure 2:
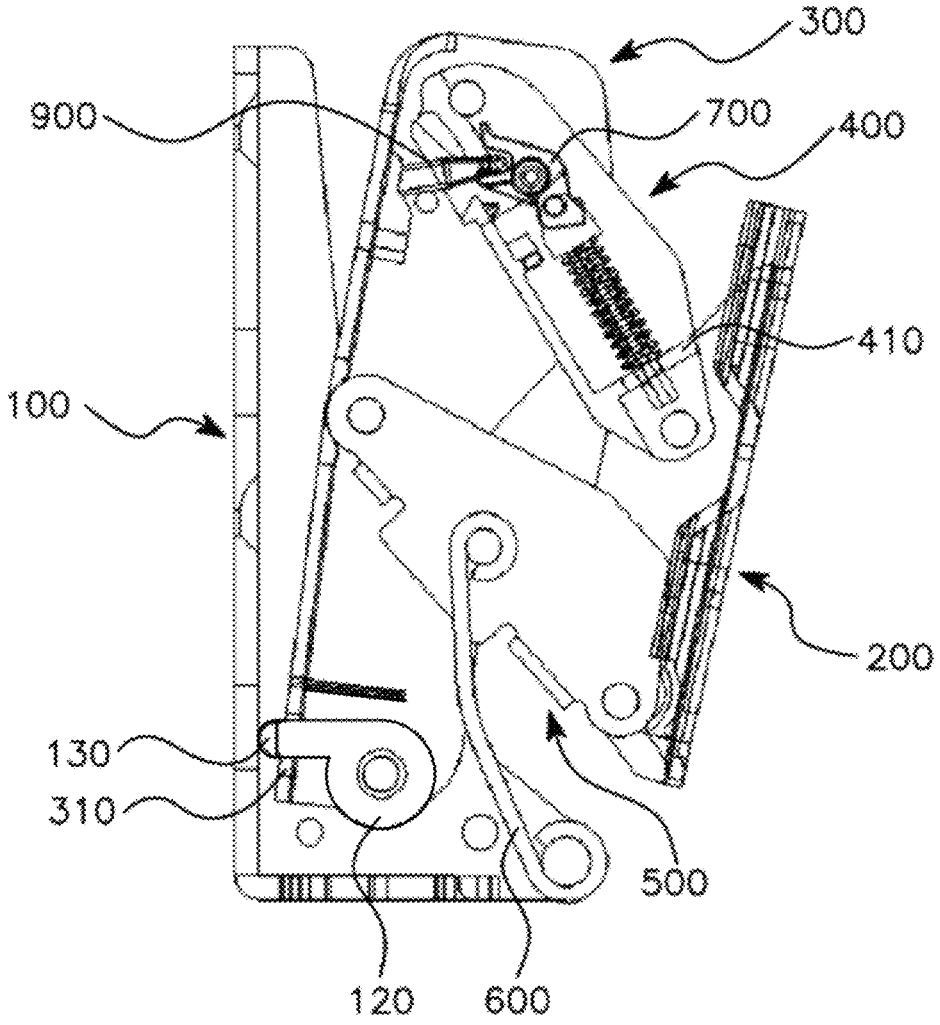

Meanwhile, as illustrated in FIG. 2, a cylindrical cam 120 is fixedly provided on the rotating shaft of the main frame 100 and the body frame 300 between the side walls of the body frame 300. Furthermore, a longitudinal hole 310 is provided in the bottom plate of the body frame 300, and a bumper protrusion 130 is provided on an outer circumferential surface of the cylindrical cam 120 by protruding therefrom along a tangential direction thereof and comes into contact with the angle plate of the main frame 100 by passing through the longitudinal hole 310 immediately prior to the closing of the door.

Accordingly, the bumper protrusion 130 comes into contact with the angle plate of the main frame 100 immediately prior to the closing of the door and generates a force of rotating the cylindrical cam 120 in a direction contrary to a rotating direction (a closing direction of the door) of the body frame 300, thereby absorbing shock occurring during the closing of the door.

Based on the above detailed description, the operation processes of the locking piece 700, the elastic member 800, and the hook 900 of the multi-link door hinge according to the present invention will be described sequentially from FIG. 5 to FIG. 1 in response to the closing motion of the door.

Figure 5:
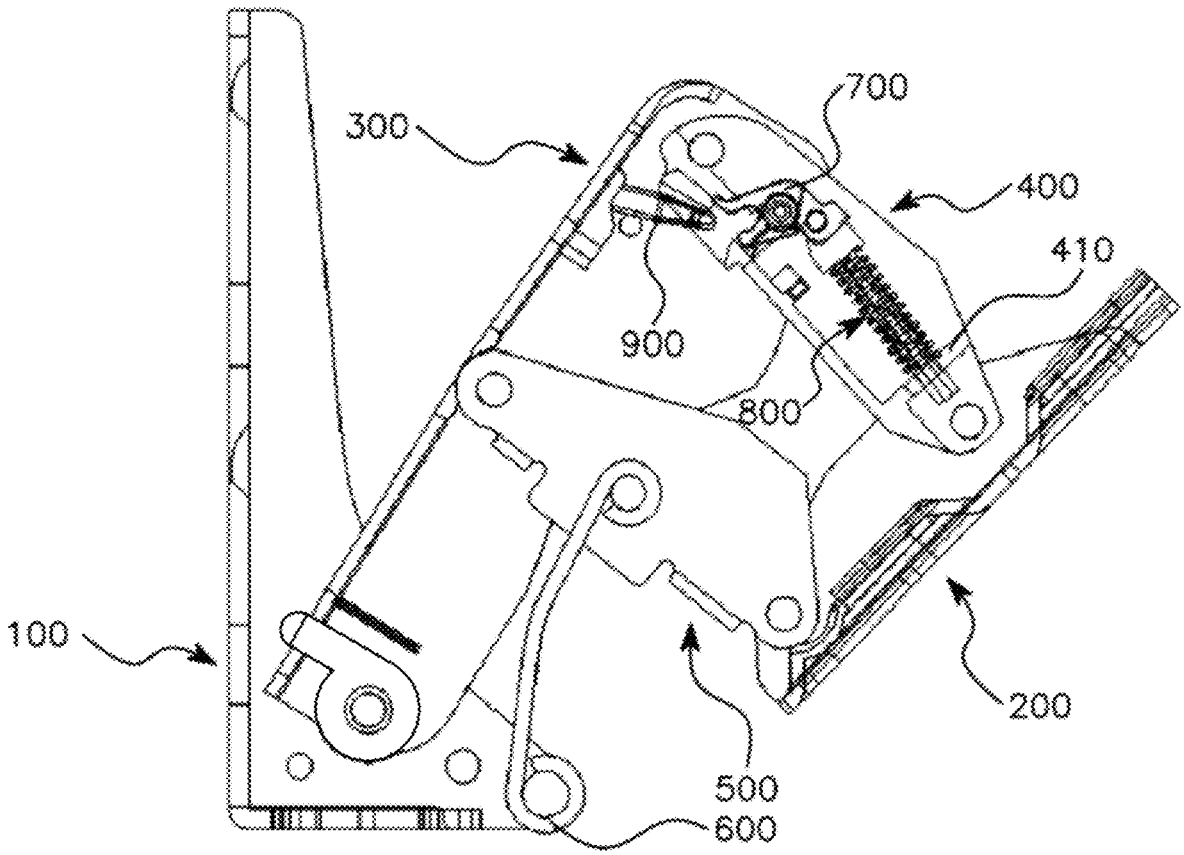

As illustrated in FIG. 5, the hook 900 is removed from and free from the locking piece 700, and the locking piece 700 is rotated counterclockwise by the pushing force of the elastic member 800, but to limit the rotation, the nose part 730 and the end part of the jaw part 740 are held by the stopper provided in the vicinity of the open part formed in the bottom plate of the inner link 400.

Figure 4:
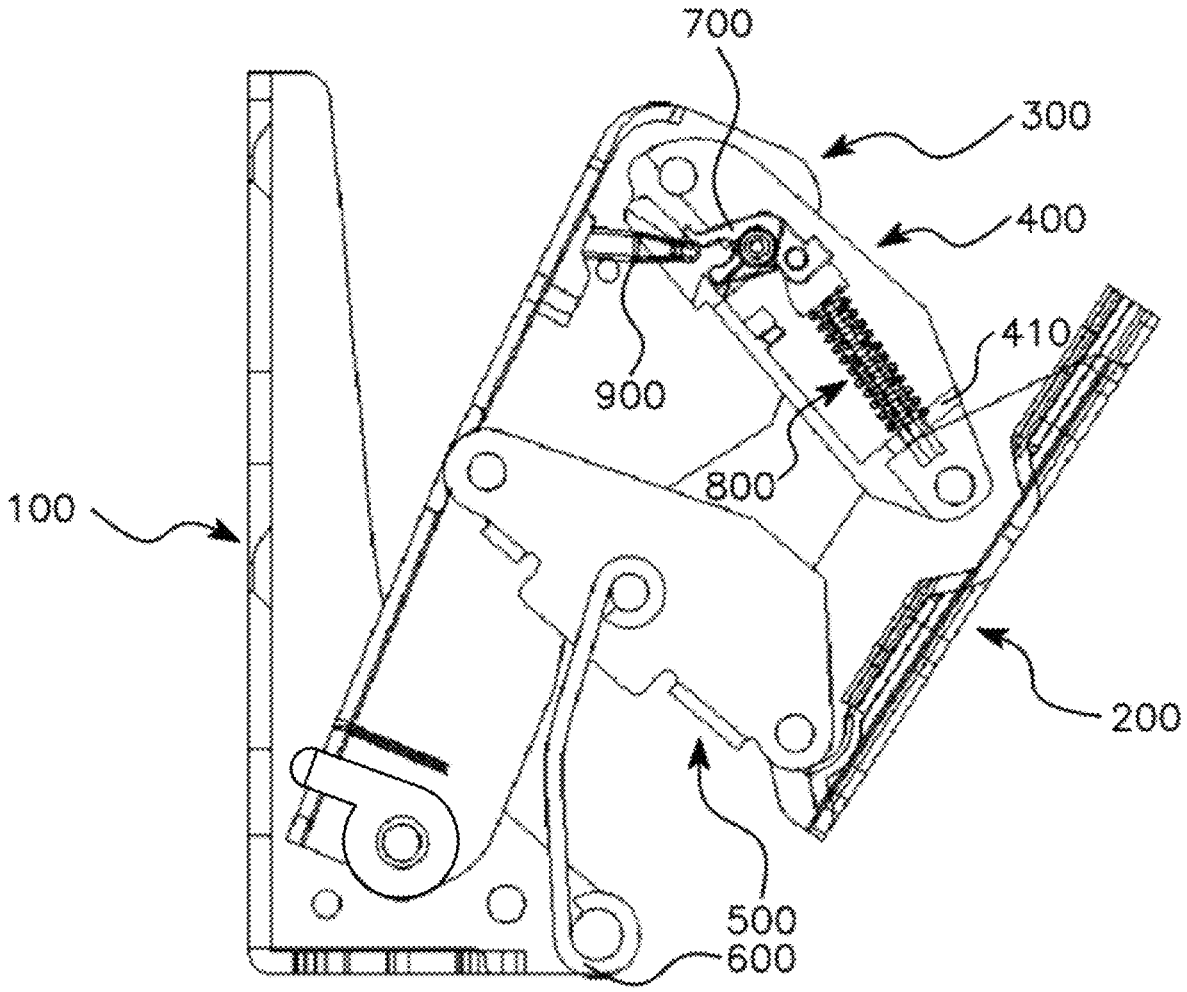

Next, as illustrated in FIG. 4, the hook 900 is still removed from the locking piece 700, and the locking piece 700 is rotated clockwise by the pushing force of the elastic member 800.

Figure 3:
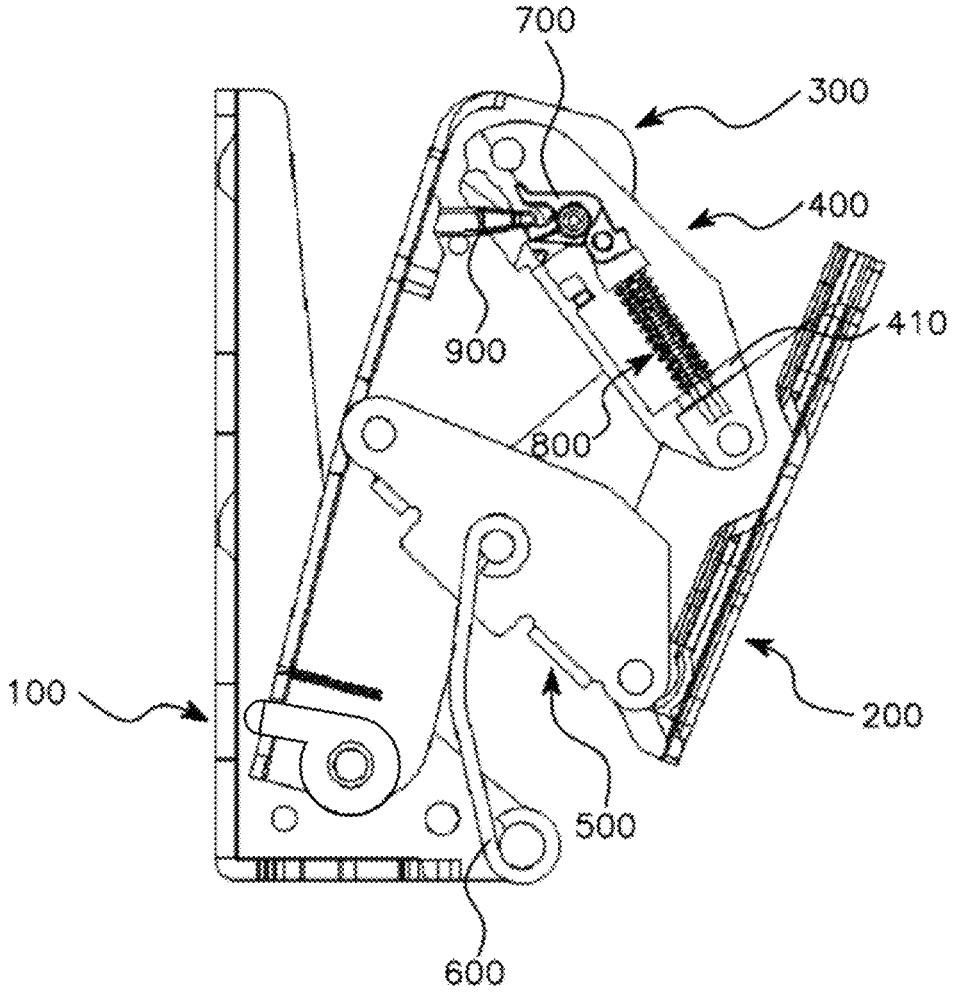

Next, as illustrated in FIG. 3, the hook 900 is held in an entrance of the locking mouth 750 of the locking piece 700, the locking piece 700 is rotated clockwise, and the elastic member 800 is located on the same line as a rotating shaft of the locking piece 700, so the pushing force is canceled instantaneously.

Next, as illustrated in FIG. 2, as the locking piece 700 is further rotated clockwise, the hook 900 transmits the pushing force caused by the elastic member 800 to the body frame 300 while inserted into and held in the locking mouth 750 of the locking piece 700 and maintains the force (a force to keep the door closing) of closing the door.

As illustrated in FIG. 1, immediately before the door is closed, as the locking piece 700 is still further rotated clockwise, the hook 900 maintains the state of being inserted into and held in the locking mouth 750 of the locking piece 700. This may be regarded as if the locking piece 700 is rotating relative to the connection bar 930 of the hook 900, and the force of closing the door (a force of preventing the door from opening easily after the door is closed) is maintained by continuously transmitting the pushing force by the elastic member 800 to the body frame 300.

Accordingly, the closing of the door is guaranteed, whereby a user's convenience is facilitated and the effect of preventing the function deterioration of a refrigerator due to the unintentional opening of the door is realized.

Although the exemplary embodiment of the present invention has been described for illustrative purposes, those skilled in the art will appreciate that various modifications, additions and substitutions are possible, without departing from the scope and spirit of the invention as disclosed in the accompanying claims.

As described above, the embodiment disclosed in the present invention and the accompanying drawings are intended not to limit but to describe the technical spirit of the present invention, and the scope of the technical spirit of the present invention is not limited by the embodiment and the accompanying drawings. The protection scope of the present invention should be interpreted by the following claims, and all technical ideas within the scope equivalent thereto should be construed as being included in the scope of the present invention.

What is claimed is:

1. A multi-link door hinge comprising:

a main frame mounted to a main body of an object having a door;

a door frame mounted to the door;

a body frame rotatably connected to a first side of the main frame;

an inner link and an outer link connecting the door frame to the body frame such that the door frame and the body frame are to be rotated relative to each other;

a plate spring link rotatably connecting the outer link to the main frame;

a locking piece rotatably mounted between side walls of the inner link;

an elastic member, a first side of which is provided in the inner link and a second side of which is rotatably combined with a first side of the locking piece to provide a pushing force to the locking piece, so that the locking piece is to be rotated counterclockwise in response to an opening motion of the door and the locking piece is to be rotated clockwise in response to a closing motion of the door; and a hook, a first side of which is fixed in the body frame and a second side of which is configured to be held in a second side of the locking piece, so that the hook is held in the locking piece in response to the closing motion of the door and the pushing force caused by the elastic member is transmitted to the body frame, thus facilitating the closing of the door, wherein the locking piece comprises:

a body part having a first hinge hole through which the body part is connected to the side walls of the inner link;

a pair of bracket wings provided by extending from a first side of the body part, a second hinge hole being provided in each of the bracket wings;

a nose part provided by extending from a second side of the body part, the nose part comprising a first concave surface part configured by being concavely rounded on a lower surface thereof and a convex surface part configured by being convexly rounded at an end part of the first concave surface part; and a jaw part provided by extending from a lower surface of the body part, and comprising a second concave surface part configured by being concavely rounded at a side opposing to the first concave surface part and a protruding surface part provided by protruding from an end part of the second concave surface part, wherein the jaw part defines a locking mouth in cooperation with the nose part such that the hook is inserted into and held in the locking mouth.

2. The multi-link door hinge of claim 1, wherein the elastic member comprises:

a spring holder having a rod, a first side of which is inserted into an installation hole provided in a fixing plate installed in the inner link, and a head provided at a second side of the rod and arranged between the bracket wings, the head having a joint groove part through which the head is rotatably connected to the second hinge hole; and a spring inserted into the rod and supported by the fixing plate at a first side thereof and being in close contact with the head at a second side thereof, thus supplying the pushing force to the locking piece.

3. The multi-link door hinge of claim 1, wherein a first end of the hook is fixed to the body frame and a connection bar is provided in a second end of the hook, so that when the locking piece is rotated clockwise at a predetermined angle or more in response to the closing motion of the door, the hook is gradually inserted into and held in the locking mouth so as to transmit the pushing force caused by the elastic member to the body frame.

4. The multi-link door hinge of claim 1, further comprising:

a cylindrical cam provided on a rotating shaft of the main frame and the body frame, and a bumper protrusion provided on an outer circumferential surface of the cylindrical cam by protruding therefrom along a tangential direction thereof and configured to come into contact with the main frame immediately prior to the closing of the door.

* * * * *